United States Patent [19]

Leibowitz

[11] Patent Number: 4,523,337

[45] Date of Patent: Jun. 18, 1985

[54] CONTOURED APPAREL

[76] Inventor: Martin N. Leibowitz, 1155 Hillsboro Mile, Ste. 602, Hillsboro Beach, Fla. 33062

[21] Appl. No.: 490,586

[22] Filed: May 2, 1983

[51] Int. Cl.[3] ..... A41F 9/02

[52] U.S. Cl. ..... 2/237

[58] Field of Search ..... 2/236, 237, 227, 221, 2/220, 76, 406, 403, 311

[56] References Cited

U.S. PATENT DOCUMENTS

| | | | |
|---|---|---|---|
| 2,392,761 | 1/1946 | Pease, Jr. | 2/311 |
| 2,401,457 | 6/1946 | Bryant | 2/406 |
| 2,742,647 | 4/1956 | Khalil | 2/236 |
| 2,757,381 | 8/1956 | Le Cottier et al. | 2/237 |
| 2,904,042 | 9/1959 | Arkus | 2/403 X |
| 3,078,469 | 2/1963 | Lynam | 2/237 X |
| 3,491,763 | 1/1970 | Osterman et al. | 2/406 |
| 3,555,569 | 1/1971 | Jones | 2/237 X |
| 3,711,868 | 1/1973 | Kristoy | 2/237 |
| 3,735,424 | 5/1973 | Maggio et al. | 2/237 X |
| 4,173,976 | 11/1979 | Bloomquist et al. | 2/403 X |
| 4,400,832 | 8/1983 | Kinder | 2/406 |

*Primary Examiner*—H. Hampton Hunter

*Attorney, Agent, or Firm*—Hubbard, Thurman, Turner & Tucker

[57] ABSTRACT

Apparel adapted to cover the lower portion of the human torso includes a contoured waistband portion having opposed sides which extend adjacent to or slightly above the upper edges of the hip bones and extend generally across the lower back and the lower front abdomen in a downwardly extending converging V shape. The waistband portion is formed of a fabric having a high degree of stretch along stretch and recovery lines which converge in a downward direction toward the longitudinal vertical centerline of the torso. A form fitting undergarment including the waistband configuration is formed of a knit or woven fabric stretchable and recoverable along the same general direction as the recovery forces exerted on the waistband and includes improved leg opening and crotch panel construction for comfort and ease of movement.

8 Claims, 11 Drawing Figures

CONTOURED APPAREL

BACKGROUND OF THE INVENTION

1. Field of the Invention

The present invention pertains to apparel such as pants and other articles worn to cover the lower half of the torso and supported generally by a waistband which is adapted to support the article on the wearer's body and to assist in supporting the lower front abdominal wall by being contoured to ride along or over the top portion of each of the hip bones and converging toward the lower front portion of the abdomen.

2. Background

Conventional garments which are adapted to cover the wearer's lower abdomen and be supported by a waistband are basically designed for a body shape wherein the front abdominal wall is relatively flat. A wide variety of garments in the prior art such as slacks, form fitting spotswear, undergarments, and maternity clothing have traditionally been fabricated with a straight circular waistband. Such waistbands may be formed with so called stretch fabrics of on type or another and are fabricated as a relatively narrow or sometimes relatively wide straight cylindrical band. This configuration of garments that are to be supported by constriction of the waistband to grip the wearer's torso may be reasonably comfortable for a body shape wherein the waist is narrower than the hips and the front abdominal wall is relatively flat. However, a great number of people, both young and old, either have a weight distribution which produces a somewhat protruding abdomen or have weakened abdominal muscles which require that garments with conventional waistbands be worn particularly tight around the waist in order to keep the garment from slipping or falling off the wearer.

The configuration of conventional apparel requires that the waistband be drawn so tight or that a belt be drawn so tight when worn by a person having a somewhat distended abdomen to the extent that, not only is the garment uncomfortable to the wearer but, impairment of the function of internal organs may result and blood circulation may be reduced. Moreover, the somewhat tourniquet effect that is imposed on the torso when wearing apparel with conventional a configuration of waistband structure may contribute to weakening the abdominal muscles and the further accumulation of fat around the waist, hips and lower abdominal area. Accordingly, the configuration of the waist area of conventional garments has not only ignored a long standing problem but is indicated to have aggravated the problem of discomfort, has adversely affected the function of body organs and has contributed to poor personal appearance. However, with the discovery of the present invention there is provided a unique garment construction which is adapted to be used in conjunction with all types of garments which are supported on and supportive of the wearer in the area of the waist and lower abdomen.

SUMMARY OF THE INVENTION

The present invention pertains to improved apparel adapted to cover at least the lower portion of the torso, supported by the abdominal area of the torso and including a contoured waistband structure which remains in the intended place or position, is more comfortable to the wearer, permits greater freedom of movement in all types of body motion, aids in supporting the back and lower abdominal area of the wearer, does not adversely affect body functions including blood circulation, and presents a neat appearance for wearers of many types of torso shapes.

In accordance with one aspect of the present invention there are provided various embodiments of garments such as trousers or slacks, form fitting sportswear and undergarments which include a waistband portion which is contoured to engage the abdominal area along opposite sides thereof and generally adjacent as well as slightly above the upper portion of the opposed hip bones or iliums, which waistband converges from the opposed sides in a generally downward direction towards the lower front of the abdomen in a generally V shaped configuration. In accordance with another aspect of the present invention there is provided a garment having a waistband wherein the portion of the waistband covering the wearer's backside also converges from the portion covering or extending above the opposed hip bones towards the center of the wearer's back at a point below the top of the opposite sides of the waistband.

In accordance with still another aspect of the present invention there is provided a garment having a supporting waistband portion which is formed of a fabric wherein the waistband will stretch and recover along lines of force which extend in a generally V configuration from the vertical centerline of the lower abdomen upward towards the opposed sides of the hips of the wearer toward the tops of the opposed hip bones.

In accordance with yet another aspect of the present invention there is provided a garment adapted to be supported on the wearer generally by the lower half of the torso, having a waistband configured in accordance with the present invention and also being adapted to use a belt as a separate element having a contour which, when worn by the wearer, extends generally adjacent to and over the upper edge of the opposed hip bones, downwardly towards the center of the lower portion of the abdomen along the front portion of the wearer and also extends downwardly towards the center of the wearer's backside in the direction of the coccyx.

In carrying out the concept of the contoured waistband of the present invention there is also provided an improved waistband structure for trousers and other garments supported on and by the lower portion of the torso having a face fabric layer cut in such a way that stretch and recovery forces extend generally along a V shaped force diagram between the lower center of the abdominal area and the top of the opposed upper hip bones or iliums. The waistband structure may include a face fabric of a woven or knit configuration which provides for stretch and recovery forces along the aforementioned directional lines when worn and may have an elastic inner liner formed of a highly elastic material using Spandex or other stretch yarns which are woven into the face fabric or laminated thereto by an adhesive or the like. The inner liner may also be formed of stretchable elastic type nonwoven fabrics.

In accordance with yet another aspect of the present invention there are provided garments such as form fitting undergarments or sportswear having a waistband configuration in accordance with the present invention and further being formed of a fabric which is adapted to stretch and exert recovery forces along lines which generally extend from the opposite outer sides of the wearer's hips in a somewhat V configuration downward with respect to the longitudinal centerline of the torso of the wearer of the garment. The form fitting garments in accordance with the present invention also include an improved construction of the crotch area of the garment having separate crotch panel portions which are cut and fastened to front and back panels of the garments in such a way as to provide an enlarged area which reduces binding and provides more comfort for the wearer. Further in accordance with the abovedescribed embodiment of the present invention the crotch panels as well as the front and back panels are cut from knit or woven fabric wherein the stretch and recovery forces extend longitudinally of the panels or transversely of the panels.

Those skilled in the art will recognize the abovedescribed features and advantages of the present invention as well as other superior aspects thereof upon reading the detailed description which follows in conjunction with the drawings.

DESCRIPTION OF THE PREFERRED EMBODIMENTS

Figure 1:
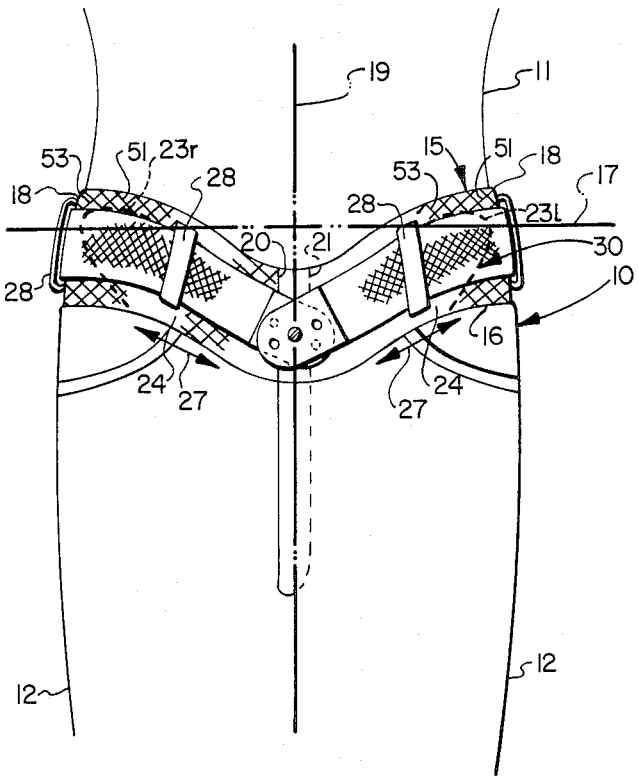
FIG. 1 is a front elevation view of a human torso showing a garment having a waistband configuration in accordance with the present invention.

In the description which follows like parts are marked throughout the specification and drawings with the same reference numerals, respectively. The drawings are not necessarily to scale and certain features of the structure of the articles of the present invention may be exaggerated in scale to better illustrate the inventive concept. The term garment or apparel as used herein is not intended to be limited necessarily to the specific embodiments of the garments illustrated. The inventive concept contemplates the provision of a garment which is supported by and is supportive of the lower portion of the human torso including the area of the waist and lower abdomen.

Figure 2:
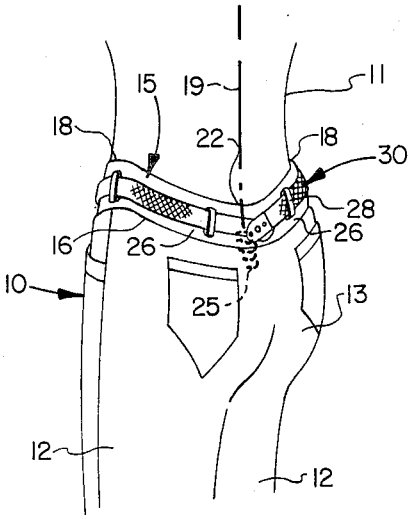
FIG. 2 is a perspective view of the backside of the torso showing the garment illustrated in FIG. 1.

Referring to FIGS. 1 and 2, there is illustrated a garment having the improved waistband configuration of the present invention, which garment is characterized as a pair of men's or women's trousers, generally designated by the numeral 10, and shown on a human torso 11. The trousers 10 are of conventional construction in the sense that they have two leg portions or panels 12 and a seat area 13 which may be formed in accordance with one of several techniques for fabricating such garments. Moreover, the material may be selected from one of many materials which are appropriate for such garments. The trousers 10 include an improved waistband which, in accordance with one embodiment of the present invention, may comprise a separate element which is sewn to the panels forming the legs and seat portions. Alternatively, the particular contoured waistband of the present invention may be formed as an integral part of the panels forming the trousers as well as the other garments described herein.

The waistband for the trousers 10 is generally designated by the numeral 15 and may be sewn to the panels 12 along a seam 16. The configuration of the waistband 15 is particularly unique and produces a synergistic effect heretofore unappreciated in the art. By way of example, the reference line 17 indicates the normal waistline of a pair of conventional trousers which would include a conventional circular waistband. However, in accordance with the present invention it has been determined that an improved garment may be obtained which is more comfortable to wear, is more easily supported on the torso of a person having a relatively flat front abdominal wall, as well as a person having a somewhat distended wall from weak abdominal muscles or from excess fat tissue, and which includes opposed portions shaped to extend over and preferably partially above the upper edges of the opposed hip bones, specifically the iliums.

The opposed upper or hip portions of the waistband 15 are each generally designated by the numeral 18 and extend above the normal waistline 17 and the iliums 23*l* and 23*r*, FIG. 1. The waistband 15 is further configured across the front portion thereof to extend in a generally downward direction towards the lower portion of the abdomen and to converge to a central depression from the opposed hip portions 18 in a somewhat V configuration to the longitudinal centerline 19 of the torso. Of course, if the trousers are provided with a conventional fly flap, the waistband terminates on the front side at the adjacent end portions 20 and 21 and may be formed with conventional cooperating fasteners, not shown, for securing the end portions 20 and 21 to each other.

Referring also to FIG. 2, the backside of the waistband 15 is also adapted to be contoured to converge from the opposed hip portions 18 toward a center portion 22 which is normally below the waistline 17 and converges generally downward toward the coccyx 25 of the wearer and toward the centerline 19. Accordingly, the waistband 15 is provided with opposed front portions 24 which converge toward each other and terminate at a lowermost point at the vertical centerline 19. The backside of the waistband includes opposed portions 26 which converge toward the lowermost center portion 22. This contour has several advantages, particularly, when formed of an elastic or stretch material which exerts recovery forces for supporting the garment to which the waistband is attached or forms a part thereof. Moreover, the particular contour of the waistband 15 is supportive of the front abdominal muscles and also the lower portion of the wearer's back to provide greater comfort to and support of the torso. The configuration of the waistband 15 also reduces the tendency for the garment to slip downwardy over the opposed hip bones and also has a tendency to retain a shirt or blouse which may be tucked in between the waistband and the wearer's torso.

One of the principal advantages of the waistband 15 is provided by utilizing a stretch or elastic material wherein stretch and recovery forces are exerted between the opposed hips and the center of the abdomen and the center of the back generally along opposed vector lines 27 which converge toward each other and downwardly toward the pelvic area at the centerline 19. The directional vector lines or arrows 27, indicating the direction of stretch and recovery forces for the waistband 15, also apply to the backside of the waistband.

The stretch and recovery forces exerted by the waistband 15 may be provided utilizing several stretch type fabrics. For example, a conventional woven fabric may be used and which is cut on a bias whereby both the warp and fill threads extend at an angle with respect to the longitudinal centerline 19, respectively. This configuration allows the waistband to stretch and exert recovery forces along the lines 27 to hold the trousers in the position shown in snug but comfortable fitting relationship to the wearer's hips and also in supportive relationship to the lower back and the lower front abdominal wall. Embodiments of the structure of a waistband in accordance with the present invention will be described further herein in conjunction with FIGS. 4 and 5. The waistband 15 may be provided with belt loops 28 spaced apart in a conventional manner but arranged to follow the contour of the waistband 15.

Figure 3:
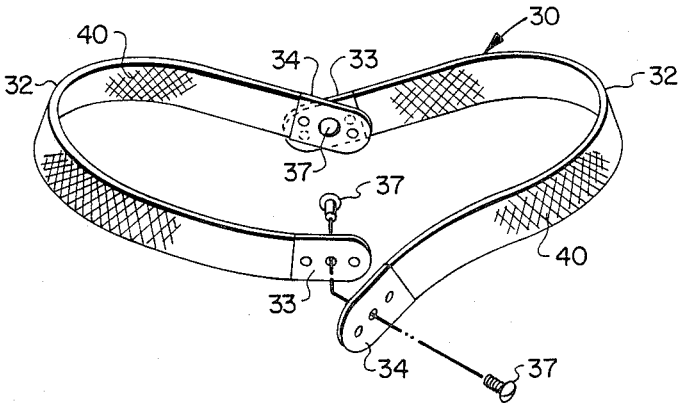
FIG. 3 is a perspective view of a belt having the configuration of the garment waistband of the present invention.

Referring now to FIG. 3, there is illustrated an embodiment of a contoured belt which may be worn in conjunction with the trousers 10 if the waistband was or was not formed of an elastic stretchable material. If, for example, the waistband 15 was formed of a fabric which was not capable of power stretch, or if the wearer of the garmet was required for any reason to wear a belt, a belt such as that illustrated in FIG. 3 and generally designated by the numeral 30 would be highly preferred. The belt 30 is configured to include opposed portions 32 which are arranged to ride adjacent to or slightly over the upper edges of the opposed hip bones of the wearer and contoured to converge along the back and front generally downwardly to respective ends 33 and 34. One of the belt portions 32 is also shown in plan view in FIG. 3A. The belt 30 is provided with suitable fastening means 37 not unlike a threaded collar button assembly and adapted to be secured to the belt ends 33 and 34 together by being placed through conventional button holes 38 and 39. The belt 30 is also configured to provide elastic stretch and recovery forces exerted along lines which converge downwardly toward each other from the side portions 32.

Figure 3A:
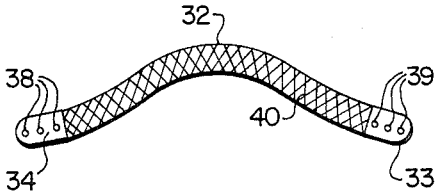
FIG. 3A is a plan view of one of the separate belt portions of the belt of FIG. 3.

Referring briefly to FIG. 3A, the belt 30 is preferably formed of two half sections 40, one shown in FIG. 3A, having the upwardly projecting hip portion 32 generally centrally disposed between the opposed end portions 33 and 34. The belt 30 is configured such that the contour provides for the central hip portion 32 to extend upward in a gentle curve from the lower or downwardly converging end portions 33 and 34. When two belt portions 40 are secured together at their respective ends 33 and 34, for example, they naturally take the same configuration as the waistband 15, and when worn in conjunction with a pair of trousers such as the trousers 10. The belt illustrated in FIGS. 3 and 3A may be formed in a manner similar to a preferred embodiment of the waistband 15 which will be described in conjunction with FIGS. 4 and 5.

Figure 4:
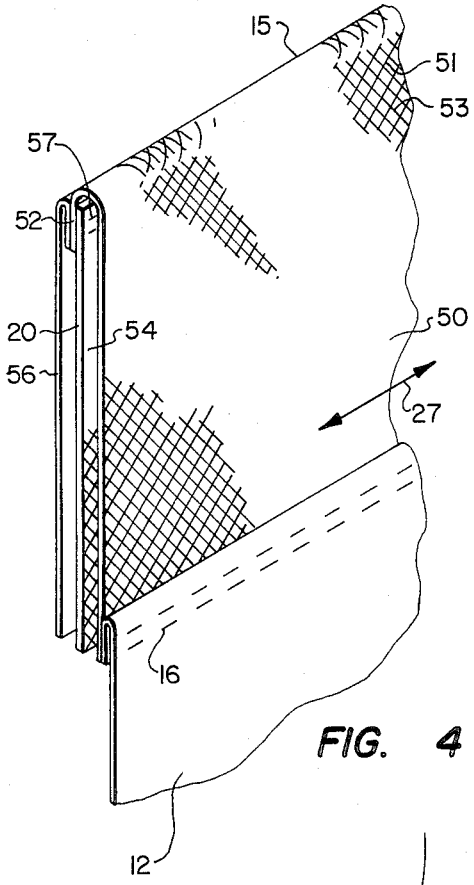
FIG. 4 is a detail perspective view of one embodiment of the structure of an elastic waistband in accordance with the present invention.

Referring now to FIG. 4, there is illustrated a detail view showing the construction of the waistband 15 and which may also preferably comprise the construction of the sections 40 of the belt 30. FIG. 4 shows a detail view of a portion of the upper edge of one of the trouser panels 12 secured to a layer of woven fabric, generally designated by the numeral 50. The fabric 50 may be formed of stretchable threads or yarns in a knit or woven configuration and is shown as a plain weave with warp and fill threads 51 and 53, and which fabric has been cut on a bias such that it may stretch and recover along a line coinciding with the directional arrow 27. The fabric layer 50 is preferably bonded or otherwise secured at the end 52 to a layer of power elasticized fabric or other liner generally designated by the numeral 54. The upper end 52 of the fabric layer 50 is also preferably secured to an inner lining 56 which is also preferably a loosely woven material cut on a bias corresponding to the cut of the fabric layer 50 so that it may stretch with the fabric layer 50 in the same direction. The inner liner 56 may be formed of the same material as the fabric layer 50 or the fabric layer 56 may be a cotton or other blended weave or knit suitable for contact against the wearer's skin and also to assist in gripping the skin and/or securely holding the cloth of a blouse or shirt. The fabric waistband layer 50 together with the liner 56 may be formed of a knit or weave having sufficient power stretch and recovery capabilities as to perform the intended supporting function of the waistband; however, the elastic liner 54 is preferably provided for this purpose. The liner 54, may be, for example a solid sheet of elastomeric stretchable material, a plain weave of yarns of material such as Spandex, or other manmade elastomeric fibers or blended stretch fibers. The liner 54 may also be formed of a nonwoven bonded fabric which is oriented to provide the stretch and recovery forces in the direction indicated. An important consideration is that the orientation of the liner 54 be such that when stretched in the direction along a line coinciding with the arrow 27 recovery forces are exerted in the opposite direction. The inner liner 56 and the liner 54 are preferably secured to the upper end 52 of the fabric layer 50 by suitable stitching 57, FIG. 4. The lower edges of the liners 56 and 54 may also be stitched to each other and to the lower edge of the layer 50.

Figure 5:
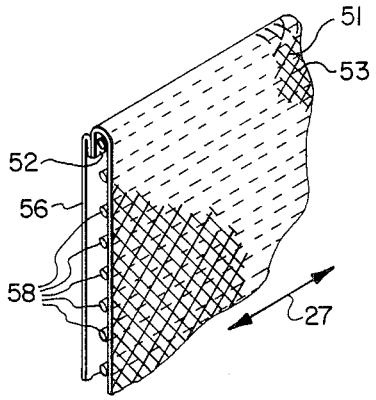
FIG. 5 is a detail perspective view similar to FIG. 4 showing an alternate embodiment of the fabric structure of an elastic waistband.

FIG. 5 illustrates an alternate embodiment of a waistband using elastomeric yarns 58 extending in the direction of the arrow 27. The yarns 58 as well as the fabric liner 54, shown in FIG. 4, may be laminated to the fabric layers 50 and 56 using a suitable adhesive that will not fail when the garment is subjected to washing or dry cleaning. As illustrated in FIG. 4, the waistband 15 is suitably stitched to the panel 12 at the seam 16 or to the face fabric of the trousers which fabric may be cut in a suitable manner depending on the type of fabric being used.

The waistband 15 may be formed as a separate element and suitably attached to trousers, shorts, maternity clothing, skirts and other types of outer garments as well as form fitting sportswear such as swim suits and undergarments. Moreover, the belt 30 may be adapted to be used with conventional clothing or as a utility belt for use by policemen, military personnel, or other workers wherein attachments such as holsters or hooks for pieces of portable equipment may be attached to the belt. The important consideration is that the belt is contoured to be supported on the wearer wherein stretch and recovery forces exerted on the belt by the articles secured thereto and by the wearer's body contours, particularly the front abdominal wall, enhances the gripping or supporting action of the belt. In like manner, the elasticity built into the belt and/or the waistband described above provides support for the wearer's lower abdomen and lower back.

Figure 6:
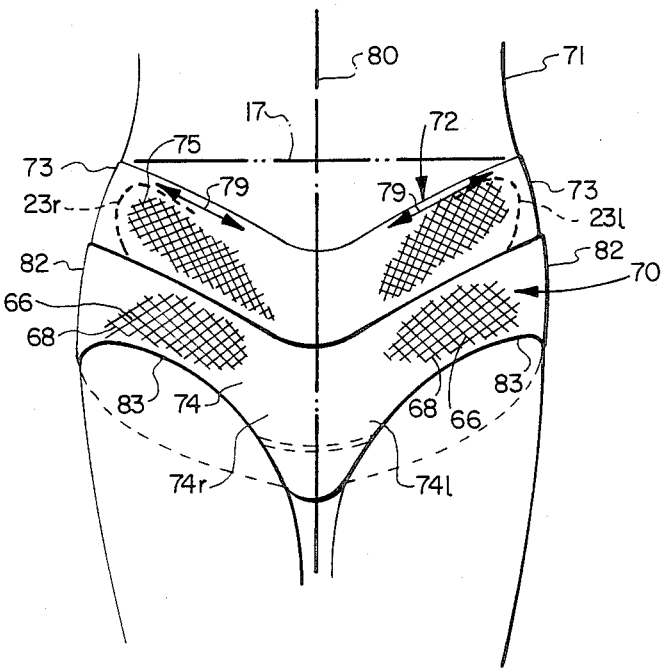
FIG. 6 is a front elevation view of a garment such as a form fitting undergarment or a pair of swim trunks in accordance with the present invention.
Figure 7:
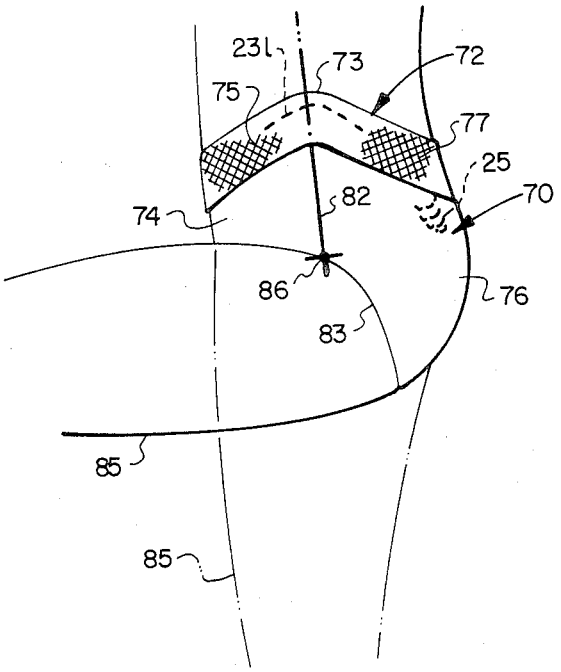
FIG. 7 is a side elevation of the garment illustrated in FIG. 6.
Figure 8:
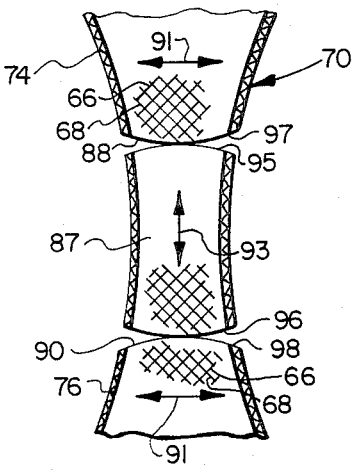
FIG. 8 is a detail view of an improved configuration of the crotch area of a garment of the type illustrated in FIGS. 6 and 7.

Referring now to FIGS. 6, 7 and 8 there is illustrated an embodiment of the present invention comprising a garment such as a pair of form fitting swim trunks or an undergarment, generally designated by the numeral 70. The garment 70 is adapted to cover the lower portion of a human torso 71 and includes a contoured waistband 72 which may be formed as an integral part of the garment or a separate part sewn to front and back panels of the garment, each generally designated by the numerals 74 and 76, respectively. The waistband 72 includes opposed portions 73 adapted to ride at least partially above the upper edge of the iliums 23*l* and 23*r* and front and back contoured portions 75 and 77 which form a somewhat V shaped contour in a relaxed state as well as when worn on the torso 71. The waistband 72 is adapted to formed of a fabric which exerts relatively strong stretch and recovery forces along opposed lines 79 which converge from the opposite edge portions 73 downwardly towards the longitudinal centerline 80 of the torso 71. The garment 70 may be formed of front and back panels which are joined to each other along side seams 82 or the front and back panels may be otherwised formed such that, for example, the panels are made from an integral piece of fabric.

However, in accordance with the teachings of the present invention it is important that the fabric from which the garment 70 is formed to be of a knit or woven configuration which will exert strong stretch and recovery forces along the directions of the arrows 79 in FIG. 6 as well as along directional lines parallel thereto. Such stretch and recovery may be obtained, for example, by forming the front and back panels 74 and 76 of a plain weave cut on a bias with respect to the longitudinal vertical centerline 80 so that warp and fill threads 66 and 68 extend at an acute angle with respect to the centerline 80. In order to orient the weave properly on both the left and right sides of the front and back panels 74 and 76 it may also be necessary to form cuts along the centerline 90 and connect left and right panels 74*l* and 74*r*, for example, at a seam coinciding with the centerline.

The configuration of the garment 70 is also such that the contour of opposed leg openings 83, when viewed from opposite sides of the wearer, provides for the upper edges delimiting the openings 83 to pass through the horizontal axes of rotation of the wearer's legs 85 as defined by the point 86 in FIG. 7. In this way, the combination of the garment edge defining the leg openings 83 together with the waistband configuration and the bias cut of the material, or alternatively a material configuration which will allow stretch and recovery forces along the lines and directions indicated, will not ride up on the wearer, will not pull down in response to substantial leg movements and accordingly will be more comfortable when worn and will remain in the intended position thereby not requiring frequent "pull up" or other adjusting movements.

Figure 9:
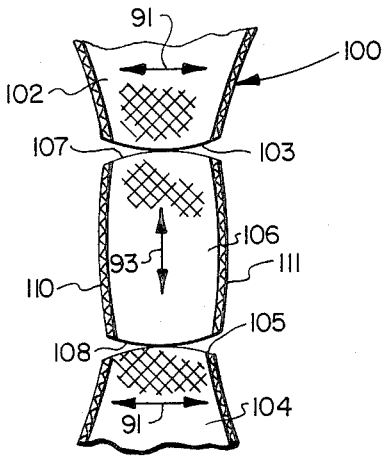
FIG. 9 is a detail view similar to FIG. 8 showing an alternate embodiment of the configuration of garment crotch panels.
Figure 8A:
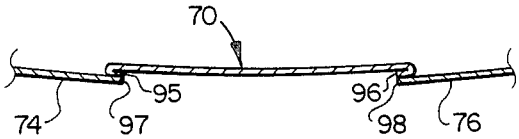
FIG. 8A is a detail longitudinal section view showing the arrangement fastening the garment panels together for the garment illustrated in FIGS. 8 and 9.

Referring now to FIGS. 8, 8A and 9, the configuration of the form fitting garment 70 is further enhanced by the provision of an improved crotch panel, generally designated by the numeral 87 in FIG. 8, which is formed by cutting spaced apart opposed dart shaped openings 88 and 90. The cut of the fabric of panels 74, 76 and the resultant panel 87 is preferably in a bias, as illustrated, so that stretch and recovery forces may be exerted along the directions indicated by the arrows 91 and 93 in FIG. 8. The garment 70 is finish fabricated by aligning the opposed edges 95 and 96 of the panel 87 with the opposed edges 97 and 98 of the respective front and back panels and sewing the crotch panel to the front and back panels such that the edges of the crotch panel and/or the front and back panels are reversely turned or folded back. In FIGS. 8A the edges 95 and 96 of the panel 87 have been folded over to be aligned with the respective edges 97 and 98. In this way, a somewhat cup shape is given to the crotch area of the garment to provide more comfort for the wearer.

Referring now to FIG. 9 an alternate embodiment of the form fitting garment previously described is illustrated in part and generally designated by the numeral 100. The garment 100 is similar to the garment 70 and includes front and back panels 102 and 104, respectively, having opposed transverse edges 103 and 105 which are adapted to be secured to a crotch panel, generally designated by the numeral 106 along respective opposed edges 107 and 108. That is, the edge 103 is aligned with the edge 107 and the edge 105 is aligned with the edge 108. The primary difference between the garments in FIGS. 8 and 9 are that the opposed longitudinal sides of the crotch panel 106, which are designated by the numerals 110 and 111, are convex. As with the garment 70, the panels of the garment 100 are suitably formed of a variety of woven or knit fabrics which will be configured to be stretched in the directions of the arrows 91 and 93 and also exert relatively strong recovery forces in those directions. The dart shaped openings formed between the front and back panels 102, 104 and the crotch panel 106 are typically larger than in the garment 70 whereby the cup shape resulting from final assembly of the panels in the garment 100 will be relatively larger than for the garment 70.

Those skilled in the art will appreciate from the foregoing that a particularly advantageous form of contoured apparel has been provided by the present invention wherein a great deal of additional comfort is afforded by apparel which is worn over the lower portion of the human torso and is typically supported on and by the torso. In regard to the present invention not only is the torso supportive of the garment but forces exerted which tend to hold the garment in place also are supportive of the abdominal wall and the lower back of the torso. The particular configurations of waistband construction illustrated and described herein are advantageous; however, those skilled in the art of stretch fabrics will recognize that a wide variety of fabric combinations and structural arrangements may be utilized in forming the waistband and garments of the present invention wherein relatively high degrees of stretch are possible and moderate to strong recovery forces of the stretched fabric are exerted.

Those skilled in the art will recognize that various other substitutions and modifications may be made to the specific embodiments described herein without departing from the scope and spirit of the invention as recited in appended claims.

What I claim is:

1. A garment constructed to cover at least a lower portion of the human torso, said garment including means forming a waistband having opposed side portions extending in an upward curvature over the wearer's iliums when worn and generally downwardly across the wearer's lower front abdominal wall to a generally central depression situated below the wearer's waistline, and said opposed side portions also extending generally downwardly across the wearer's back toward a generally central depression situated below the wearer's waistline and above the coccyx, said opposed side portions being secured to each other at said central depressions, respectively, and said side portions being formed so as to have at least a first layer of woven fabric wherein the warp and fill threads are directed so as to intersect opposed converging lines of force exerted by said waistband which extend from the top edges of respective ones of the wearer's iliums generally downwardly at an acute angle and converging toward the longitudinal vertical centerline of said torso at said respective central depressions, said means forming said waistband being adapted to exert stretch and recovery forces along said converging lines whereby said garment is retained on said torso in supportive relationship thereto by said forces acting solely along said converging lines on said waistband.

2. The garment set forth in claim 1 wherein:
said waistband includes a second layer attached to said first layer and including elastomeric means operable to stretch and recover in a direction parallel to said converging lines, respectively.

3. The garment set forth in claim 2 wherein:
said second layer includes a plurality of elastomeric threads extending parallel to said converging lines, respectively.

4. The garment set forth in claim 3 wherein:
said first and second layers are bonded to each other along contiguous surfaces thereof.

5. The garment set forth in claim 2 together with:
a third layer of fabric being stretchable in the directions of said converging lines, respectively and attached to said first and second layers of fabric along a common edge.

6. The garment set forth in claim 1 wherein:
said waistband is formed integral with at least one panel part of said garment.

7. The garment set forth in claim 1 wherein:
said waistband is formed by a separate element and is attached to another part of said garment along a longitudinal side of said waistband.

8. A garment adaped to be supported on and covering at least a lower portion of the human torso, said garment including means forming a waistband having a contour which in a relaxed state includes opposed side portions extending when worn in the intended position at least partially above the upper edges of the iliums, respectively, said waistband extending from said side portions generally downwardly across the wearer's lower front abdominal wall to a generally central depression situated below the wearer's waistline, and said waistband extends from said side portions, respectively, generally downward across the wearer's back toward a central depression situated below the wearer's waistline and above the coccyx, said waistband is formed of a fabric adapted to stretch and exert recovery forces along opposed converging lines extending parallel to lines extending from the top edges of respective ones of the wearer's iliums generally downwardly at an acute angle and converging toward the longitudinal vertical centerline of said torso, said garment comprises a form fitting trunk portion comprising front and back panels formed of a fabric adapted to stretch and exert recovery forces along lines parallel to said converging lines and extending over the lower front abdominal wall and extending across the wearer's back and downward toward the coccyx and at an acute angle with respect to the longitudinal vertical centerline of said torso, and a relatively short crotch panel formed as a separate part by cutting at least one of said front and back panels to form said crotch panel having convex front and back edges secured to corresponding convex edges of said front and back panels, respectively, said crotch panel being folded over at said front and back edges and extending between said front and back panels to form a cup shaped portion of said garment, and said fabric of said crotch panel is adapted to stretch and exert recovery forces along a line generally parallel to the longitudinal extent of said crotch panel.

* * * * *

UNITED STATES PATENT AND TRADEMARK OFFICE

CERTIFICATE OF CORRECTION

PATENT NO. : 4,523,337

DATED : June 18, 1985

INVENTOR(S) : Martin N. Leibowitz

It is certified that error appears in the above-identified patent and that said Letters Patent is hereby corrected as shown below:

Column 1, line 20, "fitting spotswear" should be --fitting sportswear--.

Column 5, line 4, "garment to slip downwardy" should be --garment to slip downwardly--.

Column 8, line 9, "panel 87 is preferably in a bias," should be --panel 87 is preferably on a bias--.

Column 10, line 8, "A garment adaped to" should be --A garment adapted to--.

Signed and Sealed this

*Twenty-fourth* Day of *September 1985*

[SEAL]

*Attest:*

*Attesting Officer*

DONALD J. QUIGG

*Commissioner of Patents and Trademarks—Designate*